US008648239B2

(12) United States Patent
Tommasi

(10) Patent No.: US 8,648,239 B2
(45) Date of Patent: Feb. 11, 2014

(54) RIGID PLECTRUM FOR STRINGED INSTRUMENTS

(76) Inventor: Stefano Tommasi, Santa Maria in Stelle (IT)

( * ) Notice: Subject to any disclaimer, the term of this patent is extended or adjusted under 35 U.S.C. 154(b) by 25 days.

(21) Appl. No.: 13/577,587

(22) PCT Filed: Nov. 23, 2010

(86) PCT No.: PCT/IB2010/055371

§ 371 (c)(1),
(2), (4) Date: Aug. 7, 2012

(87) PCT Pub. No.: WO2011/098870

PCT Pub. Date: Aug. 18, 2011

(65) Prior Publication Data

US 2012/0325071 A1 Dec. 27, 2012

(30) Foreign Application Priority Data

Feb. 12, 2010 (IT) ..... VR2010A0026

(51) Int. Cl.
*G10D 3/16* (2006.01)

(52) U.S. Cl.
USPC ..... 84/322; 984/123

(58) Field of Classification Search
USPC ..... 84/322; 984/123
See application file for complete search history.

(56) References Cited

U.S. PATENT DOCUMENTS

| | | | | | |
|---|---|---|---|---|---|
| 1,444,982 | A * | 2/1923 | Orth | 84/322 |
| 1,547,560 | A | 7/1925 | Burdwise | |
| 2,170,179 | A | 8/1939 | Wolcott | |
| 4,253,372 | A * | 3/1981 | Filipetti | 84/322 |
| D330,905 | S * | 11/1992 | Thomas | D17/20 |
| 5,194,680 | A * | 3/1993 | Reineck | 84/320 |
| 5,610,349 | A * | 3/1997 | Fogarty et al. | 84/322 |
| 6,130,374 | A * | 10/2000 | Polidori | 84/322 |
| 7,238,869 | B1 * | 7/2007 | Kleckzka | 84/322 |
| 7,265,285 | B2 * | 9/2007 | Storey | 84/322 |
| 7,683,245 | B2 * | 3/2010 | Judd | 84/322 |
| 8,426,710 | B2 * | 4/2013 | Georgatos | 84/320 |
| 2010/0083809 | A1 * | 4/2010 | Smith | 84/322 |
| 2012/0325071 | A1 * | 12/2012 | Tommasi | 84/322 |

FOREIGN PATENT DOCUMENTS

| | | | |
|---|---|---|---|
| DE | 102006054252 | A1 | 5/2008 |
| FR | 2899713 | A1 | 10/2007 |

* cited by examiner

*Primary Examiner* — Robert W Horn
(74) *Attorney, Agent, or Firm* — Pearne & Gordon LLP

(57) ABSTRACT

A rigid plectrum (1) for stringed instruments, of the type having a spearhead shape with a pointed front part (2) and a broadened rear part (3) in which, at the lateral walls (4) and (5) forming the pointed part, a first facet (4*a*) and a second facet (5*a*) are made, covering the entire thickness of the respective lateral wall; the facets being set at an angle α to the thickness of the respective lateral wall, each facet starting on one face of the plectrum which is opposite the face from which the other facet starts, and finishing on the other face of the plectrum; the facets also being set at an angle β to the face of the plectrum, from the rear part to the front part.

7 Claims, 1 Drawing Sheet

RIGID PLECTRUM FOR STRINGED INSTRUMENTS

TECHNICAL FIELD

This invention relates to a rigid plectrum for stringed instruments.

In particular, it relates to plectrums (also called "picks") having a spearhead shape, comprising a pointed front part, which makes contact with the instrument strings, and a broadened rear part which allows the plectrum to be gripped between two fingers of one hand; the shape of the plectrums being generally symmetrical relative to a central plane passing through the end part, that is to say the tip, of the pointed part. These plectrums can be used to pluck or strum, with the pointed part, the strings of a guitar to produce the desired sounds. The time which elapses between one contact of the pointed part of the plectrum with a string, and the next contact, defines the playing speed.

BACKGROUND ART

With reference to the plectrums described above, those currently in use include thin plectrums (several tenths of a millimeter), made of various material, for example plastic materials, which have significant flexibility, which is more pronounced the softer the material used to make them is.

With respect to the possibility of achieving a faster playing speed, these plectrums are less precise and more difficult to control during playing, and they obtain a sound which is not very intense and not well defined, in particular for single notes.

Very thick plectrums are also used (up to several millimeters), also made of various material, in contrast having significant rigidity which is obtained not so much because of the consistency of the material but due to its thickness. These plectrums, although not allowing fast playing speeds, are more precise and easier to control during playing, and they obtain a sound which is very intense and well defined, in particular for single notes. These plectrums are normally made thinner at the tip to increase the playing speed, even to the detriment of the positive effects given by the rigidity of the plectrum.

DISCLOSURE OF THE INVENTION

In this context, the technical purpose which forms the basis of this invention is to propose a plectrum for stringed instruments which overcomes the above-mentioned disadvantages of the prior art.

In particular, the aim of this invention is to provide a plectrum able to allow both a fast speed and good level of precision during playing, and a good intensity and definition of the sounds obtained.

Another aim of this invention is to propose a plectrum which remains well positioned between the fingers which grip it.

One advantage of the plectrum in accordance with this invention is the fact that it allows sounds with a special, extremely pleasant timbre to be obtained.

The technical purpose indicated and the aims specified are substantially achieved by a plectrum with the technical features described in one or more of the appended claims.

BRIEF DESCRIPTION OF THE DRAWINGS

Further features and advantages of this invention are more apparent from the description which follows of a non-limiting preferred embodiment of rigid plectrum for stringed instruments, illustrated in the accompanying drawings, in which.

DETAILED DESCRIPTION OF THE PREFERRED EMBODIMENTS OF THE INVENTION

Figure 1:
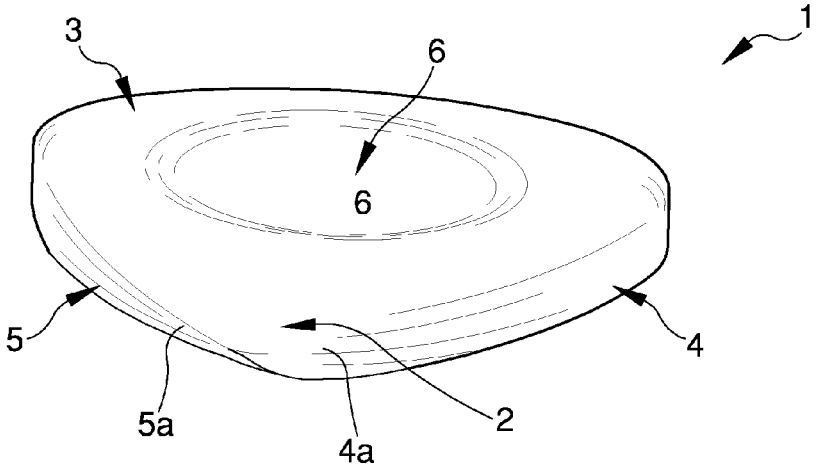
FIG. 1 is a perspective view of the plectrum according to this invention.

The plectrum 1 according to the invention is of the rigid type and can be used to play stringed instruments, in particular guitars.

Although, obviously, the greater or lesser rigidity also depends on the material used to make the plectrum, normally rigid plectrums are more than one millimeter thick. In particular, the plectrum according to this invention has a maximum thickness of approximately two millimeters. Plectrums are made of various materials, usually more or less rigid plastic materials. Other types of materials are also used (wood, ivory, etc.), which can give the sounds produced special timbres, to attempt to satisfy the requirements of the user.

Like most plectrums, the plectrum according to this invention has a spearhead shape, comprising a pointed front part 2, which during use makes contact with the strings of the instrument to produce the sounds, and a broadened rear part 3 which allows the plectrum to be gripped between two fingers of one hand. The shape of the plectrum according to the invention is symmetrical relative to a central plane which passes through the tip of the pointed part.

This shape is quite usual and common even in prior art plectrums.

At each of the lateral walls 4 and 5 of the plectrum, in particular at the parts of said walls which form the pointed front part, a facet is made, respectively a first facet 4*a* and a second facet 5*a*, covering the entire thickness of the respective lateral wall. For that purpose, each facet starts on one face of the plectrum which is opposite the face from where the other facet starts, in one of the half-planes defined by the central plane (that is to say, on one side of said central plane), and finishes on the other face of the plectrum in other half-plane defined by the central plane (that is to say, on the other side of the central plane). Each of these facets is set at an angle to the thickness of the respective lateral wall which extends substantially vertically, the amplitude of said angle $\alpha$ preferably being between 20 and 60°. Smaller angles are not appropriate, since they would reduce the thickness of the plectrum too much, whilst larger angles would not allow full obtainment of the advantages described below.

In the plectrum according to this invention each of the facets 4*a* and 5*a* described above is also set at an angle, $\beta$ to the face of the plectrum, from the rear part to the front part, the amplitude of said angle preferably being between 1 and 30°. Again, smaller angles are not appropriate, since they would make the angle $\beta$ practically null, whilst larger angles would create, close to the pointed zone, a thickset "tip" not well suited to use of the plectrum.

All of the edges of the plectrum according to this invention, like those of almost all thick plectrums, are rounded to prevent sharp edges which are not suitable for use of the plectrum. The angles of inclination of the facets 4*a* and 5*a* therefore vary, due to said rounding, close to the edges of the angled areas.

On each face of the plectrum according to this invention a recess is made, respectively 6 and 7, preferably having a curved outline and a hollow suitable for accommodating the tips of the fingers used to grip the plectrum.

Each recess being positioned approximately in the middle zone of the face and inscribed in the face; the recesses 6 and 7 being coaxial with each other.

The plectrum according to the invention may be made of various materials amongst those normally used for making plectrums. To obtain special sound timbres, the plectrum according to the invention may be made with three layers of material which are superposed in the direction of the plectrum thickness; the outer layers preferably being made of the same material as each other, which is different to the material used to make the inner layer. A combination of materials which allows a good sound timbre to be obtained is wood for the outer layers and plastic material (for example Plexiglas) or "Tagua" (ivory-nut palm) for the inner layer.

The plectrum according to the invention, in particular its facets 4*a* and 5*a* made on the lateral walls of the plectrum close to its pointed zone, and above all their special shape, provide a plectrum which allows excellent playing speed combined with optimum precision "picking", as well as significant definition of the sounds produced. The plectrum always encounters the strings, both with the away "picking" action and the return action, along an angled surface which promotes contact between the plectrum and the string and sliding of the plectrum on the string, therefore playing speed, typical of flexible plectrums. However, thanks to its shape, the plectrum does not have particularly thin zones and so allows both precision picking and definition of the sound obtained, which are typical of rigid, thick plectrums.

Thanks to the presence of the recesses 6 and 7, the plectrum according to the invention also offers a firm, secure grip for the user.

The plectrum may also be made in two different versions for right- and left-handed users.

Figure 2:
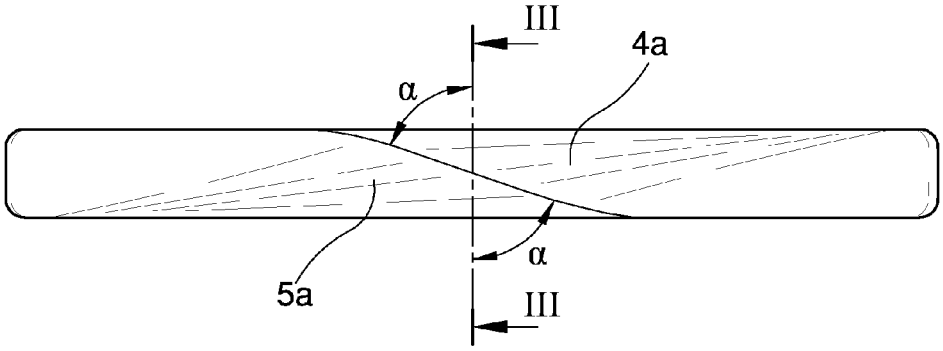
FIG. 2 is a front view, from the side where the pointed part is located, of the plectrum according to this invention.
Figure 3:
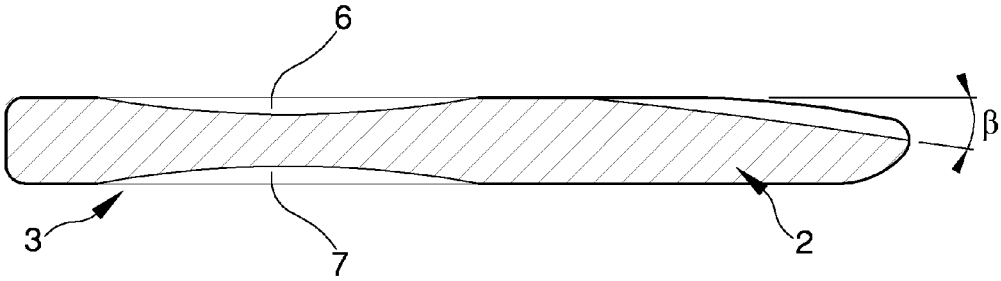
FIG. 3 is a cross-section of the plectrum according to this invention, according to the plane III-III shown in FIG. 2.

The accompanying drawings shows the version for right-handed users. In the version for left-handed users the facets 4*a* and 5*a* start on the opposite faces of the plectrum to those from which they start in the version for right-handed users. The version for left-handed users would have angles α rotated on the opposite side of the plane III-III to the angles α shown in FIG. 2.

Finally, in its "multi-layer" version made by superposing different materials to form the outer surfaces and the inner thickness, the plectrum encounters the string with the outer layer of the material and leaves it as the string slides on the inner layer. Using particular materials, such as wood and Plexiglas or Tagua palm, special and very pleasant sound timbres are obtained.

The invention claimed is:

1. A rigid plectrum (1) for stringed instruments, of the type having a spearhead shape, comprising a pointed front part (2), which is adapted to make contact with the instrument strings, and a broadened rear part (3) which allows the plectrum to be gripped between two fingers of one hand, the shape of the plectrum being symmetrical relative to a central plane passing through a tip of the pointed part, characterised in that: at each of the two lateral walls (4) and (5) of the plectrum which form the pointed front part a facet is made, respectively a first facet (4*a*) and a second facet (5*a*), covering an entire thickness of the respective lateral wall; each facet being set at an angle α relative to the thickness of the respective lateral wall, starting on one face of the plectrum, opposite the face from where the other facet starts, in one of the half-planes defined by the central plane and finishing on the other face of the plectrum in the other half-plane defined by the central plane.

2. The plectrum according to claim 1, characterised in that each facet is also set at an angle β to the face of the plectrum, from the rear part to the front part.

3. The plectrum according to claim 1, characterised in that the amplitude of the angle α is between 20 and 60°.

4. The plectrum according to claim 2, characterised in that the amplitude of the angle β is between 1 and 30°.

5. The plectrum according to claim 1, characterised in that it has rounded edges.

6. The plectrum according to claim 1, characterised in that it comprises a respective recesses (6) and (7) on each face, each recess being positioned approximately in the middle zone of the face and inscribed in the face; the recesses (6) and (7) being coaxial with each other.

7. The plectrum according to claim 1, characterised in that it is made with three layers of material which are superposed in the direction of the plectrum thickness; the outer layers being made of the same material as each other, which is different to the material used to make the inner layer.

* * * * *